US007612648B2

(12) United States Patent
Jeong et al.

(10) Patent No.: US 7,612,648 B2
(45) Date of Patent: Nov. 3, 2009

(54) DISC VARISTOR AND METHOD OF MANUFACTURING THE SAME

(75) Inventors: Jun Hwan Jeong, Incheon Metropolitan (KR); Moon Soo So, Gyeonggi-do (KR); Kyung Whan Woo, Gyeonggi-do (KR); Gu Whan Jung, Gyeonggi-do (KR)

(73) Assignee: Amotech Co., Ltd., Gyeonggi-Do (KR)

( * ) Notice: Subject to any disclaimer, the term of this patent is extended or adjusted under 35 U.S.C. 154(b) by 290 days.

(21) Appl. No.: 11/791,740

(22) PCT Filed: Jun. 9, 2005

(86) PCT No.: PCT/KR2005/001729

§ 371 (c)(1),
(2), (4) Date: May 29, 2007

(87) PCT Pub. No.: WO2006/059826

PCT Pub. Date: Jun. 8, 2006

(65) Prior Publication Data

US 2009/0121822 A1 May 14, 2009

(30) Foreign Application Priority Data

Dec. 2, 2004 (KR) ..... 10-2004-0100388

(51) Int. Cl.
*H01C 7/10* (2006.01)

(52) U.S. Cl. ..... 338/20; 338/21; 338/325; 361/820; 361/767; 174/526

(58) Field of Classification Search ..... 338/20, 338/21, 234–236, 324–325; 361/728, 767, 361/813, 820; 174/526
See application file for complete search history.

(56) References Cited

U.S. PATENT DOCUMENTS

| | | | | |
|---|---|---|---|---|
| 4,975,674 | A * | 12/1990 | Sumiyoshi et al. | 338/21 |
| 5,425,099 | A * | 6/1995 | Takakura et al. | 379/413 |
| 5,781,394 | A * | 7/1998 | Lorenz et al. | 361/124 |
| 6,211,770 | B1 * | 4/2001 | Coyle | 338/21 |
| 6,252,493 | B1 | 6/2001 | Gunchenko | |
| 6,388,555 | B2 * | 5/2002 | McLoughlin | 338/21 |

FOREIGN PATENT DOCUMENTS

| | | |
|---|---|---|
| KR | 10-1999-001961 | 1/1999 |
| KR | 10-2000-0009936 | 2/2000 |

* cited by examiner

*Primary Examiner*—Kyung Lee
(74) *Attorney, Agent, or Firm*—Dickstein Shapiro LLP

(57) ABSTRACT

Disclosed herein are a disc varistor having a capability to absorb a double amount of surge and a method of manufacturing the varistor. The varistor includes a disc-shaped first ceramic body having first and second electrodes on opposite surfaces thereof, and a disc-shaped second ceramic body having third and fourth electrodes on opposite surfaces thereof. A first lead wire is in interposed between the second and third electrodes and electrically connected to the second and third electrodes. The varistor also includes a second lead wire. The second lead wire has a body portion electrically connected to the first electrode of the first ceramic body, a first extension extending from the body portion to the second ceramic body, and a second extension extending from the first extension to the fourth electrode.

8 Claims, 9 Drawing Sheets

DISC VARISTOR AND METHOD OF MANUFACTURING THE SAME

TECHNICAL FIELD

The present invention relates generally to a disc varistor and method of manufacturing the same and, more particularly, to a disc varistor, in which two ceramic bodies are connected in parallel by using wires, so that the voltages of the two ceramic bodies become equal to each other and the current (namely, surge current) corresponding to the area of the two ceramic bodies can be absorbed; and to a method of manufacturing the same.

BACKGROUND ART

There has been a rapid development of the semiconductor industry recently and an acceleration of the integration rate of realizing miniaturization and high performance of a unit device. Thus, the operating voltage of electronic equipments or the like has a tendency of being gradually reduced. Conversely, when a surge voltage is applied, thermal energy, high enough to burn electronic parts, is generated, thus rapidly reducing the energy carrying capacity of a semiconductor. Therefore, the capability to cope with surges has dramatically been reduced.

As equipments including semiconductor devices are susceptible to excessive voltage, such devices may be destroyed or degraded when excessive voltage is supplied for even a relatively short duration of several microseconds (μs), thus reducing the lifespan of equipments or deteriorating the functionality of the equipments. For these reasons, it is necessary to develop a varistor that can be operated at micro-voltage.

A varistor is defined as a semiconductor device having a highly nonlinear volt-ampere characteristic. The electrical characteristics of the varistor are similar to the function of a Zener diode, which has constant voltage characteristics. However, the varistor is a composite ceramic device that has larger current and energy capacity.

The nonlinear characteristic of the varistor has very large electric resistances at low voltages. The resistance has a grain boundary phenomenon showing the nonlinear characteristic. That is, when the voltage exceeds a predetermined threshold voltage depending on the microstructure and size of the device, the electric resistance is abruptly reduced.

The nonlinear resistance characteristic is controlled by a process that occurs at the grain boundary. The nonlinear resistance characteristic is similar to a breakdown observed at a back-to-back Zener diode, but has larger energy absorbing capability.

Varistors have been used to stabilize voltage, quench sparks of contact points, or absorb surges in electronic circuits. Further, the varistors may be employed in an arrester for protecting an electrical system from lightning.

As shown in FIG. 1, the method of manufacturing a conventional disc varistor is as follows. That is, an electrode 2 is applied to a surface of a ceramic body 1, while an electrode 3 is applied to the opposite surface of the ceramic body 1. Lead wires 4 and 5 to be connected to a circuit (e.g. printed circuit board) are soldered respectively to the electrodes 2 and 3. Afterwards, a coating process with an insulating material comprising epoxy 6 is carried out. In this regard, the varistor having the electrodes 2 and 3 on opposite surfaces thereof is manufactured.

DISCLOSURE

Technical Problem

Recently, due to the miniaturization of electronic equipments and integration of electronic circuits, a varistor suitable for a wide range of use has been developed. For example, a varistor used in the interior of a car or a computer must be able to absorb a surge voltage of 20V or less.

However, when the conventional disc varistor, which was described with reference to FIG. 1, is applied to a car, the disc varistor is problematic in that it is difficult to absorb surges having high energy generated by the car, especially, a load dump generated during the starting of the motor because it has one ceramic body.

Due to the recent trend toward the electronization of cars, it has become difficult to cope with electromagnetic compatibility (EMC), which is required in cars.

This invention has been proposed, in order to solve such problems. The object of the present invention is to provide a disc varistor having the capacity to absorb a double amount of surge and the method of manufacturing the varistor.

Technical Solution

In order to accomplish the above object, the present invention provides a disc varistor, including a first ceramic body having a disc shape, with a first electrode provided on a first surface of the first ceramic body and a second electrode provided on a second surface of the first ceramic body; a second ceramic body having a disc shape, with a third electrode provided on a first surface of the second ceramic body and a fourth electrode provided on a second surface of the second ceramic body, the third electrode being arranged to face the second electrode of the first ceramic body; a first lead wire interposed between the second and third electrodes, and electrically connected to the second and third electrodes; and a second lead wire including a body portion electrically connected to the first electrode of the first ceramic body, a first extension provided by bending the second lead wire at a predetermined position thereof, the first extension extending from the body portion to the second ceramic body, and being spaced apart from the outer circumference of the first and second ceramic bodies, and a second extension provided by bending the second lead wire at a predetermined position thereof, the second extension extending from the first extension to the fourth electrode of the second ceramic body, and being electrically connected to the fourth electrode of the second ceramic body.

Preferably, the length of the second extension of the second lead wire is less than half the length of the fourth electrode surface. Further, a first guide groove, having a length corresponding to a portion contacting the body portion of the second lead wire is, patterned on a surface of the first electrode of the first ceramic body, the first electrode being connected to the body portion of the second lead wire; and a second guide groove, having a length corresponding to a portion contacting with the second extension, is patterned on a surface of the fourth electrode of the second ceramic body, the fourth electrode being connected to the second extension of the second lead wire.

In order to accomplish the above object, the present invention provides a method of manufacturing a disc varistor, including a first step of forming a disc-shaped first ceramic body having, on a first surface thereof a first electrode and on a second surface thereof a second electrode; and a disc-shaped second ceramic body having, on a first surface thereof a third electrode, and on a second surface thereof a fourth electrode; a second step of forming a U-shaped initial lead wire to be electrically connected to the first and second ceramic bodies and the initial lead wire being formed such that a first upper portion of the initial lead wire protrudes higher than a second upper portion of the initial lead wire; a third step of inserting the first ceramic body between the first and second upper portions of the initial lead wire, and locating the second ceramic body such that the third electrode of the second ceramic body and the second electrode of the first ceramic body are provided on opposite sides of the second upper portion of the initial lead wire, thus electrically connecting the first upper portion of the initial lead wire to the first electrode, and electrically connecting the second upper portion of the initial lead wire to the second electrode and the third electrode; a fourth step of primarily bending the upward protruding portion of the initial lead wire toward the second ceramic body, thus providing a first extension that extends to a position above the outer circumference of the second ceramic body, secondarily bending an end portion of the first extension toward the fourth electrode of the second ceramic body, thus providing a second extension, and electrically connecting the second extension to the fourth electrode; and a fifth step of cutting a lower portion of the initial lead wire to be divided into a first lead wire and a second lead wire, and coating the first and second ceramic bodies and surrounding areas with an insulating material.

Advantageous Effects

According to the present invention, a disc varistor is constructed so that two ceramic bodies are integrally connected parallel to each other. Thus, voltage of the disc varistor is equal to that of a conventional product using one ceramic body, but the surge absorbing capability of the disc varistor corresponding to the current is doubled. Further, this invention provides an optimal structure for a parallel connection.

Therefore, a load dump generated during the start-up of a car motor is efficiently suppressed. Further, it is possible to effectively cope with EMC required in cars.

Figure 1:
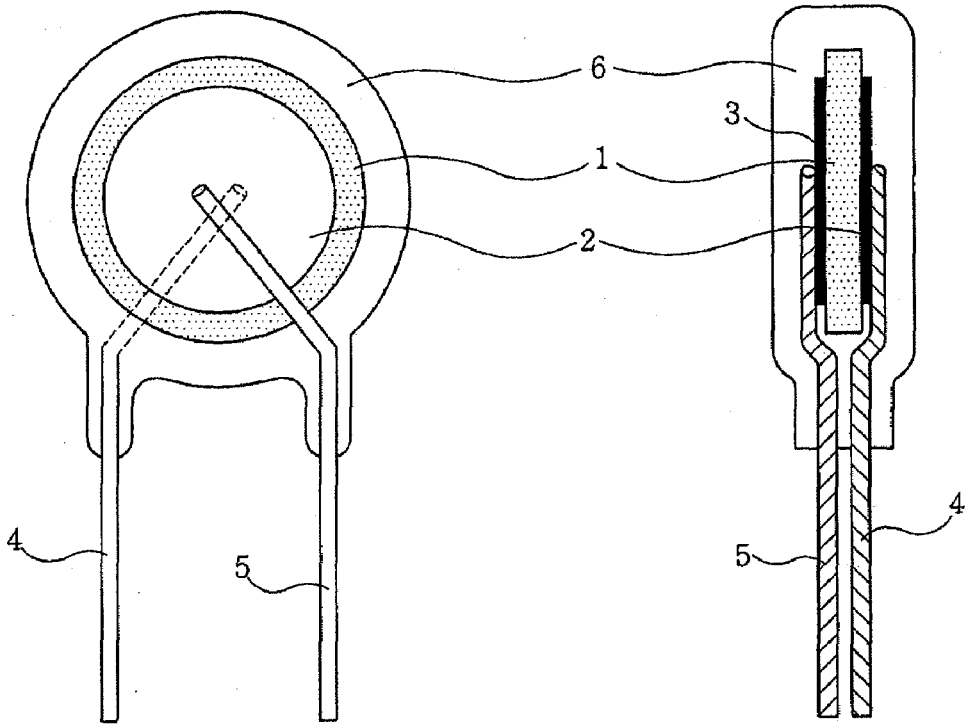
FIG.1 PRIOR ART
FIG. 1 is a view illustrating the construction of a conventional disc varistor.

*Description of reference characters of important parts*

| | |
|---|---|
| 10: first ceramic body | 12: first electrode |
| 14: second electrode | 20: second ceramic body |
| 22: third electrode | 24: fourth electrode |
| 30: first lead wire | 32: second lead wire |
| 32a: first extension | 32b: second extension |

MODE FOR INVENTION

A disc varistor and a method of manufacturing the same according to the preferred embodiment of this invention will now be described with reference to the accompanying drawings.

Figure 2:
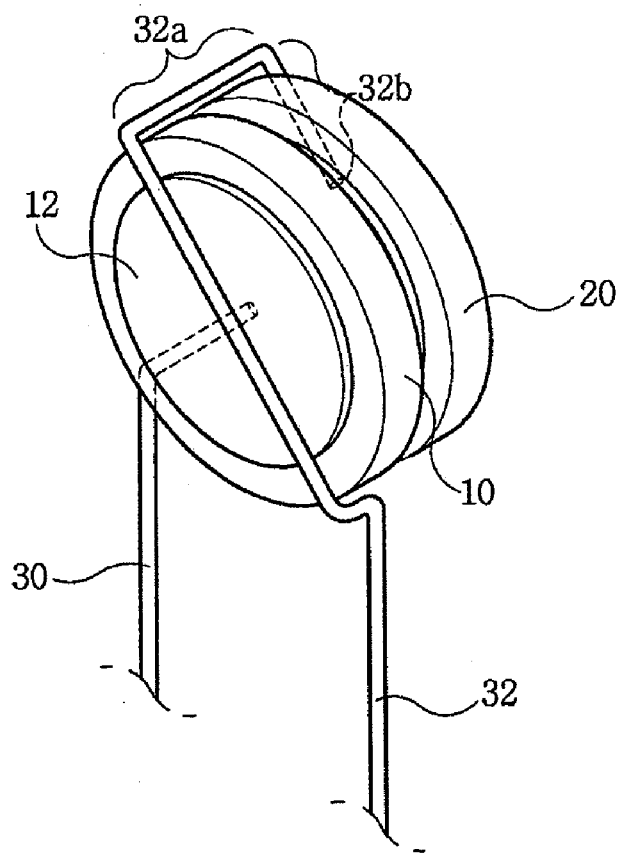
FIG. 2 is a perspective view of a disc varistor, according to the preferred embodiment of the present invention.
Figure 3:
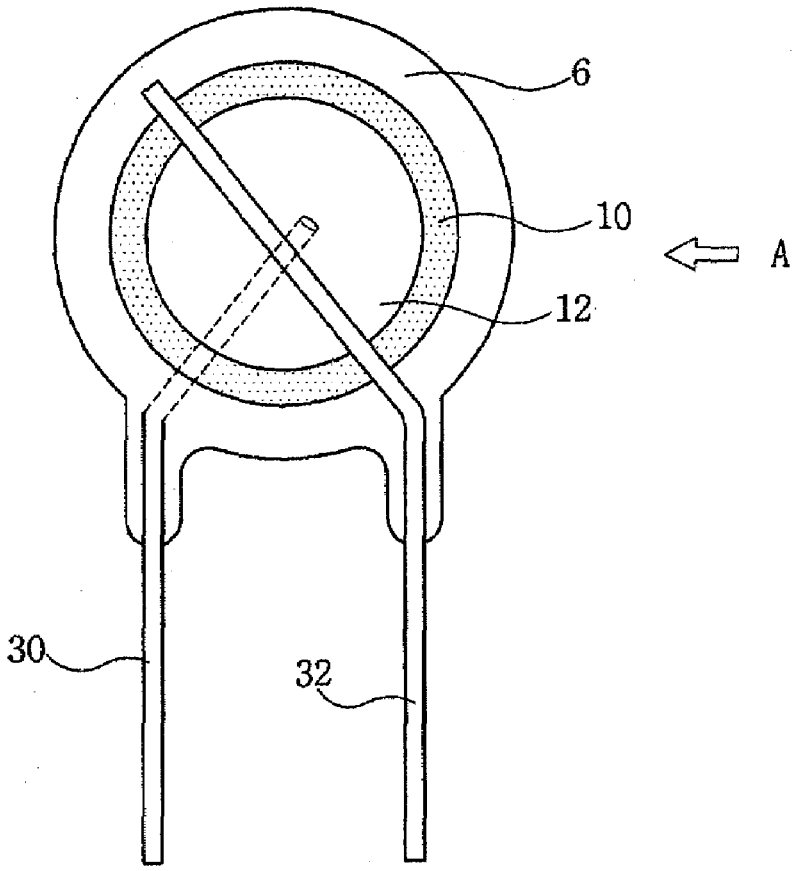
FIG. 3 is a front view of the disc varistor of FIG. 2.
Figure 4:
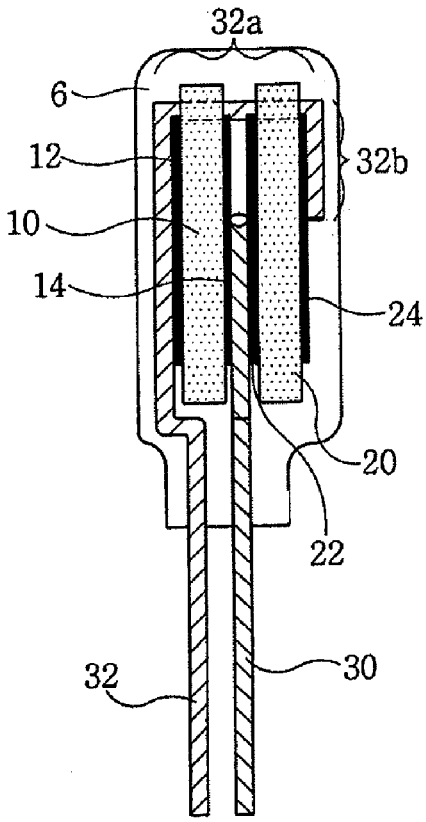
FIG. 4 is a side view of the disc varistor shown from direction "A" of FIG. 3.

FIG. 2 is a perspective view of a disc varistor according to the preferred embodiment of the present invention, FIG. 3 is a front view of the disc varistor of FIG. 2, and FIG. 4 is a side view of the disc varistor shown from direction "A" of FIG. 3. In FIG. 2, epoxy 6 is omitted. FIGS. 3 and 4 show the disc varistor, as if epoxy 6 were transparent.

According to the present invention, the disc varistor includes a first ceramic body 10 and a second ceramic body 20. The first ceramic body 10 has the shape of a disc, with a first electrode 12 printed on a surface of the first ceramic body 10, and a second electrode 14 printed on an opposite surface of the first ceramic body 10. The second ceramic body 20 has the shape of a disc, with a third electrode 22 printed on a surface of the second ceramic body 20, and a fourth electrode 24 printed on an opposite surface of the second ceramic body 20. In this case, the third electrode 22 of the second ceramic body 20 faces the second electrode 14 of the first ceramic body 10.

Further, the disc varistor of the present invention includes a first lead wire 30 and a second lead wire 32. The first lead wire 30 is interposed between the second electrode 14 and the third electrode 22 and is electrically connected to the second and third electrodes 14 and 22. A body portion of the second lead wire 32 is electrically connected to the first electrode 12 of the first ceramic body 10. A first extension 32*a* extends from the body portion to the second ceramic body 20 in such a way as to be at a right angle with the body portion. In this case, the first extension 32*a* is arranged to be spaced apart from the outer circumference of the first and second ceramic bodies 10 and 20 by a predetermined interval. Further, a second extension 32*b* extends from an end of the first extension 32*a* to the fourth electrode 24 of the second ceramic body 20 in such a way as to be at a right angle with the first extension 32*a*. The second extension 32*b* is electrically connected to the fourth electrode 24 of the second ceramic body 20.

In this case, the first and second ceramic bodies 10 and 20 are manufactured in the following order. Zinc oxide, bismuth, cobalt, manganese, nickel, etc. are mixed in predetermined proportions. The mixture produced as an oxide is sprayed and dried. Afterwards, pressure forming is executed using a mold having a predetermined diameter. Next, the product is sintered in an electric furnace at a temperature from 1000° C. to 1200° C. for about 1 hour. Thereafter, electrodes are printed on opposite surfaces of a disc, thereby completing the ceramic body.

The first and second lead wires 30 and 32 comprise nickel-plated copper wires. The second lead wire 32 is soldered to both the first electrode 12 of the first ceramic body 10 and the fourth electrode 24 of the second ceramic body 20.

Meanwhile, if the disc varistor is operated when the first extension 32*a* contacts with the first ceramic body 10 or the second ceramic body 20, voltage may fluctuate. For this reason, the first extension 32*a* of the second lead wire 32 must be spaced apart from the outer circumference of the first and second ceramic bodies 10 and 20 by a predetermined interval.

An interval between the outer circumference of the first and second ceramic bodies 10 and 20 and the first extension 32*a* is provided such that the first and second ceramic bodies 10 and 20 are not in contact with the first extension 32*a*.

Further, the length of the second extension 32*b* of the second lead wire 32 is less than half the length of the fourth electrode 24 surface. The length of the second extension 32*b* may be more than half the length of the fourth electrode 24 surface. However, as the length of the second extension 32*b* is increased, the manufacturing cost rises and the manufacturing process becomes more difficult. Thus, it is preferable that the length of the second extension 32*b* be less than half the length of the fourth electrode 24 surface.

According to the present invention, it is preferable that the length of the second extension 32*b* of the second lead wire 32 be less than the radius of the fourth electrode 24 because the first to fourth electrodes 12, 14, 22, and 24 are in a disc shape. The first to fourth electrodes 12, 14, 22, and 24 certainly could have shapes (e.g. square, rectangular, triangular, etc.) other than the disc shape, as long as the shapes do not interfere with the function of the electrodes.

The second lead wire 32 is bent at two portions thereof, thus allowing the first and second ceramic bodies 10 and 20 to be installed accurately at predetermined positions, in addition to firmly holding the first and second ceramic bodies 10 and 20, thus preventing the first and second ceramic bodies 10 and 20 from being undesirably removed from the predetermined positions.

Meanwhile, although not shown in the drawings, a guide groove may be patterned on the first electrode 12 of the first ceramic body 10 to which the body portion of the second lead wire 32 is connected. The guide groove has a length corresponding to a portion contacting with the body portion. Further, another guide groove may be patterned on the fourth electrode 24 of the second ceramic body 20 to which the second extension 32*b* of the second lead wire 32 is connected. The guide groove has a length corresponding to a portion contacting with the second extension 32*b*. As such, if the guide grooves are patterned, it is easier to connect the second lead wire 32 to predetermined positions of the first and second ceramic bodies 10 and 20.

FIGS. 5 through 9 are views illustrating the process of manufacturing the disc varistor, according to the preferred embodiment of the present invention.

Figure 5:
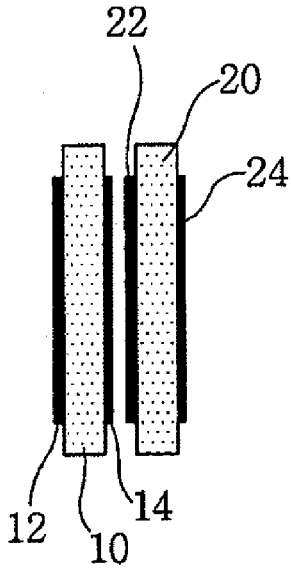
FIGS. 5 through 9 are views illustrating the process of manufacturing the disc varistor, according to the preferred embodiment of the present invention.

First, as shown in FIG. 5, the disc-shaped first ceramic body 10 and the disc-shaped second ceramic body 20 are made. The first electrode 12 is printed on a surface of the first ceramic body 10, and the second electrode 14 is printed on an opposite surface of the first ceramic body 10. Further, the third electrode 22 is printed on a surface of the second ceramic body 20, and the fourth electrode 24 is printed on an opposite surface of the second ceramic body 20.

In this case, the guide groove (not shown) may be additionally patterned on the first electrode 12 of the first ceramic body 10. Likewise, another guide groove (not shown) may be additionally patterned on the fourth electrode 24 of the second ceramic body 20. The guide grooves allow the second lead wire 32 to be more easily connected to predetermined positions of the first and second ceramic bodies 10 and 20.

In other words, the guide groove having a length corresponding to a portion contacting with the body portion may be additionally patterned on the first electrode 12 of the first ceramic body 10 to which the body portion of the second lead wire 32 is connected. Further, another guide groove having a length corresponding to a portion contacting with the second extension 32*b* may be additionally patterned on the fourth electrode 24 of the second ceramic body 20 to which the second extension 32*b* of the second lead wire 32 is connected.

Figure 6:
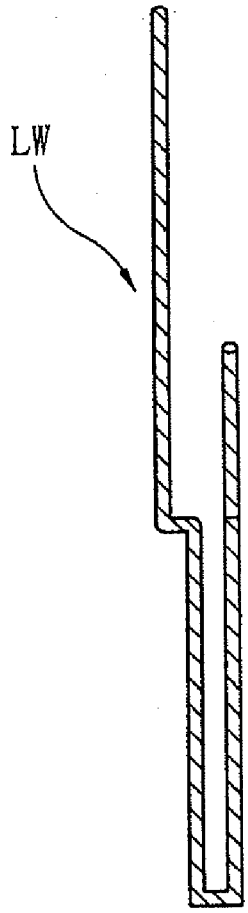

Next, as shown in FIG. 6, an initial lead wire LW having a shape similar to a U shape is manufactured. In this case, the initial lead wire LW is made such that a first upper portion of the initial lead wire LW protrudes higher than a second upper portion of the initial lead wire. Further, a step is provided on the first initial lead wire LW, and serves to indicate the insertion position of the first ceramic body 10, in addition to allowing the first ceramic body 10 to be easily secured after the first ceramic body 10 has been inserted.

According to this embodiment, after the first and second ceramic bodies 10 and 20 are manufactured, the initial lead wire LW is manufactured. However, such an order of manufacturing has been described for illustrative purposes. Thus, it is possible to manufacture the initial lead wire LW, prior to manufacturing the first and second ceramic bodies 10 and 20. Moreover, the first and second ceramic bodies 10 and 20 and the initial lead wire LW may be simultaneously manufactured in their respective production lines.

Thereafter, the first and second ceramic bodies 10 and 20 are electrically connected to the initial lead wire LW.

Figure 7:
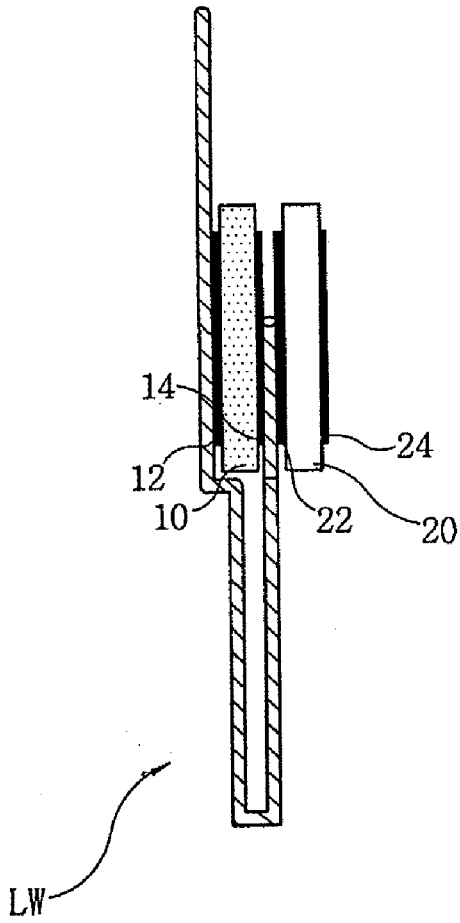

In a detailed description, as shown in FIG. 7, the first ceramic body 10 is inserted between the first and second upper portions of the initial lead wire LW. The second ceramic body 20 is positioned such that the third electrode 22 of the second ceramic body 20 and the second electrode 14 of the first ceramic body 10 are provided on opposite sides of the second upper portion of the initial lead wire LW. Afterwards, portions (i.e. the first electrode 12, the second electrode 14, and the third electrode 22) at which the initial lead wire LW contacts with the first and second ceramic bodies 10 and 20 are soldered and electrically connected to each other.

Figure 8:
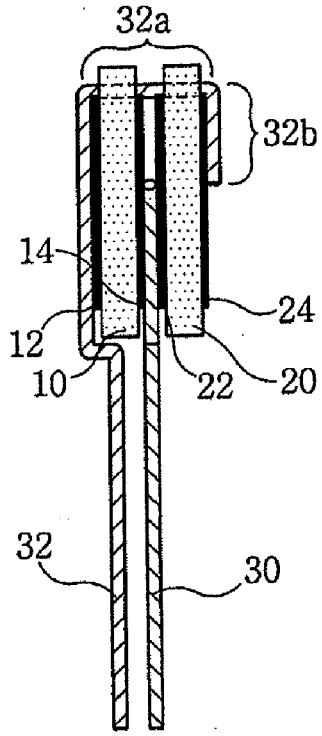

Afterwards, as shown in FIG. 8, the upward protruding part provided on the first upper portion of the initial lead wire LW is primarily bent toward the second ceramic body 20 at about 90 degrees, thus providing the first extension 32*a* that extends to a position above the outer circumference of the second ceramic body 20. Next, an end portion of the first extension 32*a* is secondarily bent at about 90 degrees toward the fourth electrode 24 of the second ceramic body 20, thus, providing the second extension 32*b*. The second extension 32*b* is soldered to the fourth electrode 24 to be electrically connected to the fourth electrode 24.

At this time, the first extension 32*a* is spaced apart from the outer circumference of the first and second ceramic bodies 10 and 20 by a predetermined interval such that the first extension 32*a* does not contact with the first ceramic body 10 or the second ceramic body 20. The length of the second extension 32*b* is set to be less than half the length of the fourth electrode 24 surface. The length of the second extension 32*b* may certainly be more than half the length of the surface of the fourth electrode 24. It is preferable that the length of the second extension 32*b* exceeds half the length of the fourth electrode 24 surface.

Thereafter, the lower portion of the initial lead wire LW is cut to be divided into the first lead wire 30 and the second lead wire 32. That is, a lead wire interposed between the first and second ceramic bodies 10 and 20 provides the first lead wire 30. A lead wire, separated from the first lead wire 30 and bent twice in a ⊂ shape, provides the second lead wire 32.

Figure 9:
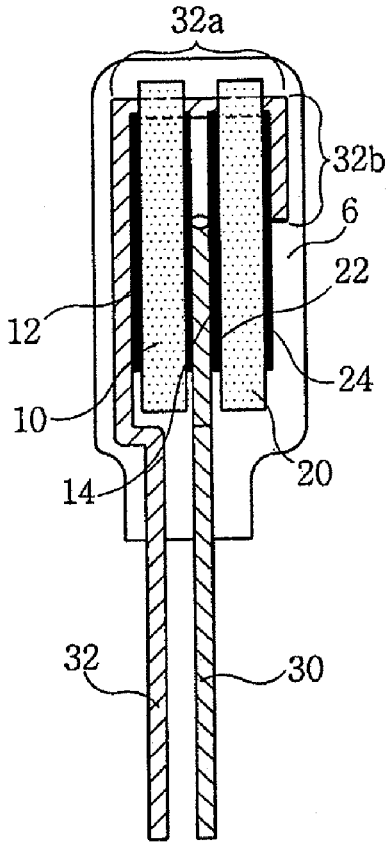

Finally, as shown in FIG. 9, the first and second ceramic bodies 10 and 20 and surrounding areas are coated with epoxy 6 to have a coating layer of a predetermined thickness.

According to the disc varistor manufacturing process that has been described with reference to FIGS. 5 through 9, the initial lead wire LW is first prepared. The first and second ceramic bodies 10 and 20 are inserted into the initial lead wire LW. Subsequently, the contacting portions of the initial lead wire LW with the electrodes (the first electrode 12, the second electrode 14, and the third electrode 22) of the ceramic bodies 10 and 20 are soldered to each other. Next, the initial lead wire LW is bent twice, and the lower portion of the initial lead wire LW is cut. The second extension 32*b* is soldered to the fourth electrode 24, prior to being coated with epoxy 6.

In the above-mentioned manufacturing process, soldering operations are carried out twice, thus inconveniencing manufacturers. Thus, the disc varistor of the present invention may be manufactured by the following method. That is, after the initial lead wire LW is prepared and the ceramic bodies 10 and 20 are inserted into the initial lead wire LW, the first upper portion of the initial lead wire LW is bent twice. Afterwards, the portions at which the initial lead wire LW contacts with the electrodes (the first electrode 12, the second electrode 14, the third electrode 22, and the fourth electrode 24) of the ceramic bodies 10 and 20 are soldered, thus reducing the number of soldering operations. Afterwards, the lower portion of the initial lead wire LW is cut, and the first and second ceramic bodies 10 and 20 and surrounding areas are coated with epoxy 6. Although this manufacturing process is not shown in the drawings, those skilled in the art can fully appreciate the manufacturing process by referencing FIGS. 5 to 9.

Although the preferred embodiment of the present invention has been disclosed for illustrative purposes, those skilled in the art will appreciate that various modifications, additions, and substitutions are possible, without departing from the scope and spirit of the invention as disclosed in the accompanying claims.

The invention claimed is:

1. A disc varistor, comprising:

a first ceramic body having a disc shape, with a first electrode provided on a first surface of the first ceramic body and a second electrode provided on a second surface of the first ceramic body;

a second ceramic body having a disc shape, with a third electrode provided on a first surface of the second ceramic body and a fourth electrode provided on a second surface of the second ceramic body, the third electrode being arranged to face the second electrode of the first ceramic body;

a first lead wire interposed between the second and third electrodes, and electrically connected to the second and third electrodes; and a second lead wire, comprising:

a body portion electrically connected to the first electrode of the first ceramic body;

a first extension provided by bending the second lead wire at a predetermined position thereof, the first extension extending from the body portion to the second ceramic body, and being spaced apart from outer circumference of the first and second ceramic bodies; and a second extension provided by bending the second lead wire at a predetermined position thereof, the second extension extending from the first extension to the fourth electrode of the second ceramic body, and being electrically connected to the fourth electrode of the second ceramic body.

2. The disc varistor according to claim 1, wherein a length of the second extension of the second lead wire is less than half the length of the fourth electrode surface.

3. The disc varistor according to claim 1, wherein a first guide groove, having a length corresponding to a portion contacting with the body portion of the second lead wire, is patterned on a surface of the first electrode of the first ceramic body, the first electrode being connected to the body portion of the second lead wire, and a second guide groove, having a length corresponding to a portion contacting with the second extension, is patterned on a surface of the fourth electrode of the second ceramic body, the fourth electrode being connected to the second extension of the second lead wire.

4. A method of manufacturing a disc varistor, comprising:

a first step of forming a disc-shaped first ceramic body having on a first surface thereof a first electrode and on a second surface thereof a second electrode, and a disc-shaped second ceramic body having, on a first surface thereof a third electrode and on a second surface thereof a fourth electrode;

a second step of forming a U-shaped initial lead wire to be electrically connected to the first and second ceramic bodies, the initial lead wire being formed such that a first upper portion of the initial lead wire protrudes higher than a second upper portion of the initial lead wire;

a third step of inserting the first ceramic body between the first and second upper portions of the initial lead wire, and locating the second ceramic body such that the third electrode of the second ceramic body and the second electrode of the first ceramic body are provided on opposite sides of the second upper portion of the initial lead wire, thus electrically connecting the first upper portion of the initial lead wire to the first electrode, and electrically connecting the second upper portion of the initial lead wire to the second electrode and the third electrode;

a fourth step of primarily bending the upward protruding portion of the initial lead wire toward the second ceramic body, thus providing a first extension that extends to a position above outer circumference of the second ceramic body, secondarily bending an end portion of the first extension toward the fourth electrode of the second ceramic body, thus providing a second extension, and electrically connecting the second extension to the fourth electrode; and a fifth step of cutting a lower portion of the initial lead wire to be divided into a first lead wire and a second lead wire, and coating the first and second ceramic bodies and surrounding areas with an insulating material.

5. The method according to claim 4, wherein, at the fourth step, the first extension is spaced apart from outer circumference of the first and second ceramic bodies.

6. The method according to claim 4, wherein, at the fourth step, a length of the second extension is less than half the length of the fourth electrode surface.

7. The method according to claim 4, wherein a first guide groove, having a length corresponding to a portion contacting with the first upper portion of the initial lead wire, is patterned on a surface of the first electrode of the first ceramic body, and a second guide groove, having a length corresponding to a portion contacting with the second extension, is patterned on a surface of the fourth electrode of the second ceramic body.

8. A method of manufacturing a disc varistor, comprising:

a first step of forming a disc-shaped first ceramic body having, on a first surface thereof a first electrode and on a second surface thereof a second electrode, and a disc-shaped second ceramic body having, on a first surface thereof a third electrode and on a second surface thereof a fourth electrode;

a second step of forming a U-shaped initial lead wire to be electrically connected to the first and second ceramic bodies, the initial lead wire being formed such that a first upper portion of the initial lead wire protrudes higher than a second upper portion of the initial lead wire;

a third step of inserting the first ceramic body between the first and second upper portions of the initial lead wire, and locating the second ceramic body such that the third electrode of the second ceramic body and the second electrode of the first ceramic body are provided on opposite sides of the second upper portion of the initial lead wire;

a fourth step of primarily bending the upward protruding portion of the initial lead wire toward the second ceramic body, thus providing a first extension that extends to a position above the outer circumference of the second ceramic body, and secondarily bending an end portion of the first extension toward the fourth electrode of the second ceramic body;

a fifth step of electrically connecting the first upper portion of the initial lead wire to the first electrode, electrically connecting the second upper portion of the initial lead wire to the second electrode and the third electrode, electrically connecting the second extension to the fourth electrode, and cutting a lower portion of the initial lead wire to divide the initial lead wire into a first lead wire and a second lead wire; and a sixth step of coating the first and second ceramic bodies and surrounding areas with an insulating material.

* * * * *